US005433919A

United States Patent [19]

Baltes

[11] Patent Number: 5,433,919

[45] Date of Patent: Jul. 18, 1995

[54] METHOD FOR DETOXICATION, AERATION, DRYING AND STERILIZATION OF FABRICS

[75] Inventor: Hans Baltes, Dortmund, Germany

[73] Assignee: Patent-und Innovationsagentur Nordrhein-Westfalen GmbH, Dortmund, Germany

[21] Appl. No.: 140,581

[22] Filed: Oct. 21, 1993

[30] Foreign Application Priority Data

Oct. 22, 1992 [DE] Germany ..... 42 35 560.5

[51] Int. Cl.[6] ..... A61L 2/04; F26B 25/06

[52] U.S. Cl. ..... 422/1; 34/225; 68/5 R; 68/5 C

[58] Field of Search ..... 422/1, 124, 125, 199, 422/292; 34/218, 219, 224, 225, 202; 68/5 R, 5 C; 223/51

[56] References Cited

U.S. PATENT DOCUMENTS

| | | | |
|---|---|---|---|
| 1,564,566 | 12/1925 | Harris | 34/225 |
| 2,606,372 | 8/1952 | Foulder et al. | 34/225 |
| 4,304,053 | 12/1981 | Kelerhals et al. | 68/5 C X |
| 4,471,537 | 9/1984 | Meda | 34/225 X |
| 4,625,432 | 12/1986 | Baltes | 34/225 X |
| 5,152,077 | 10/1992 | Liang | 34/225 X |

FOREIGN PATENT DOCUMENTS

| | | |
|---|---|---|
| 3730178 | 3/1989 | Germany . |
| 3343236 | 12/1989 | Germany . |
| 750075 | 6/1956 | United Kingdom . |

*Primary Examiner*—Robert J. Warden
*Assistant Examiner*—Theresa T. Snider
*Attorney, Agent, or Firm*—Hill, Steadman & Simpson

[57] ABSTRACT

A method and apparatus are provided for detoxicating, aerating, drying and sterilizing clothing articles. A drying chamber is provided which has an inner chamber in which the clothing articles are to be hung. A first intermediate chamber and a second intermediate chamber are provided in the walls defining the inner chamber through which air is caused to flow. A heater is provided for heating air drawn in from the room and, if preferred, a condenser may be provided for removing moisture from the air after it has passed through the inner chamber. Air may be recirculated within the drying chamber by use of the condenser, or fresh air may flow through the condenser to provide a cooling air stream to the condenser, while heated moist air flows separately through the condenser to remove heat and moisture before the air is exhausted back into the room.

7 Claims, 3 Drawing Sheets

METHOD FOR DETOXICATION, AERATION, DRYING AND STERILIZATION OF FABRICS

BACKGROUND OF THE INVENTION

The present invention relates to a method for removing chemicals present in and on clothing and an apparatus for accomplishing the method.

It is known that fabrics, garments, leather garments and shoes contain remainders of, e.g., pesticides and other chemicals which are used at the production of fibers, e.g., of cotton, during the tanning of leather, during the coloring and during the finishing of such objects. These chemicals may irritate the skin of sensitive or allergic persons particularly when wearing new garments and may lead to unpleasant reactions. For this reason the washing of new garments is recommended before wearing, whereby, however, the chemicals are not always completely removed. According to tests one to ten washings are required in order to completely remove the contaminants.

Also the sterilization of garments is a problem, because neither the washing with known washing machines nor drum drying machines achieve a sterilization.

From DE-PS 33 43 236 a method for drying and sterilizing particularly sensitive garments is known wherein both the drying and the sterilization of the garment is accomplished in the same treating chamber in a condition of hanging essentially still and the sterilization is achieved directly after the drying wherein the garment is firstly dried while using a warm air stream in the known fashion and secondly the sterilization is accomplished in a hot air stream.

The apparatus for accomplishing the method according to DE-PS 33 43 236 comprises a drying chamber with devices for hanging garment particles and with means for the generation, distribution and particularly circulation of warm air and hot air with the means comprising a fan and a heating device wherein the fan comprises a device for adjusting the volume of the air stream as is known as well as a device for switching the rotational speed of the fan in at least two stages or speeds and the drying chamber comprises an over-heating switch or thermostat activating and deactivating the heating means.

Although the known method and the associated apparatus have been proven in practical performance, it has been a disadvantage, that the complete detoxication of the fabric parts could not be accomplished.

SUMMARY OF THE INVENTION

Therefore it is an object of the present invention to further develop the known method and the known device such that, while maintaining the features of aeration, drying and sterilizing, a complete detoxication is accomplished.

This object is achieved with a method for removing chemicals present in and on clothing materials comprising the steps of supplying the materials and hot air into a drying chamber comprising an inner chamber, treating the materials by hot air at a temperature high, but not harmful for the respective kind of material, wherein the hot air is supplied through two aperture plates opposing each other and defining the inner chamber, exhausting the air through an air exhaust in a bottom wall of said inner chamber, such that at each point in the chamber about equal thermodynamic state variables, such as temperature, pressure, volume flow, chemical potential and thermodynamic imbalance arise, and that, by the increase, due to thermal conditions, a vapor pressure of the chemicals clinging to the materials at a minimum partial pressure based upon the continuous air supply, causes a maximal evaporation of the individual chemicals to be achieved.

A very efficient conduction of the air, which leads to a practically complete detoxication by blowing out the particles clinging to the textile fabrics, is achieved in that the air stream entering through the air inlet opening is heated by a heating device after passing through a first intermediate chamber. The heated air stream is conducted into the inner chamber from two sides opposing each other, and the air stream leaving the inner chamber is drawn in by a fan and directed outside through an air outlet opening. Also, the parts remote from the openings, e.g., those in the middle of the inner chamber, are reached by the air streams flowing at short distances. Furthermore, air turbulances are created by the front collision of the air streams, with the turbulances enhancing the aeration and detoxication process.

For further optimizing the conduction of the air stream, it is provided that the heated air stream is guided through a second intermediate chamber which is defined by the inward facing wall of the first intermediate chamber and the wall of the inner chamber, and that the heated air stream is guided into the inner chamber through a plurality of openings in the inward facing wall of the second intermediate chamber.

In a preferred embodiment, particularly for drying textile garments, the air stream leaving the inner chamber is guided through a condenser and afterwards drawn in by the fan. The condenser in this way acts as a cooling trap as is known e.g., the moist air is cooled at the walls of the condenser down below the dew point wherein the precipitated water is collected in a drip pan.

For enhancing the drying process it is practical that the air stream drawn in by the fan is directed through the second intermediate chamber into the inner chamber such that the air stream is moved in a closed circuit. Therein the drying process is controllable by a moisture sensor in a known way. In certain applications a process is required wherein a heating device is not activated although present, and this is particularly effectively accomplished in a method utilizing two fans to provide a recirculation.

By a combined drawing in and discharge of the two fans, a particularly effective air stream is created in that the air stream entering through the air inlet opening is guided through a condenser, the air stream leaving the condenser is drawn in by a fan and discharged into the inner chamber, and the air stream leaving the inner chamber is drawn in by a second fan and discharged through the air outlet opening.

For enhancing the mixing of the air stream it is advantageously provided that the air stream is irregularly moved by periodically activating and deactivating the fan or by periodically changing the rotational speed of the fan.

A freedom from ground related dust being drawn into the drying air stream and a good stability of the apparatus provided by a low center of gravity is achieved in that the first intermediate chamber comprises at least one air inlet opening formed in the upper area of the drying chamber, the heating device, the fan and, in the embodiments utilizing a condenser, the condenser are all arranged below the inner chamber and the openings to the drying chamber are provided into walls facing each other.

In an embodiment of the invention the condenser is coolable by an air stream produced by a second fan. Thereby only one air stream is needed in a particularly elegant manner with the air stream flowing through the condenser before being heated.

In an embodiment wherein sterilization is to be provided, the drying chamber may have a device for spraying a bacterized liquid and/or a chamber for generating ozone as is known.

BRIEF DESCRIPTION OF THE DRAWINGS

Examples of the apparatus according to the invention now are explained in more detail referring to the drawings.

DETAILED DESCRIPTION OF THE PREFERRED EMBODIMENTS

Figure 1:
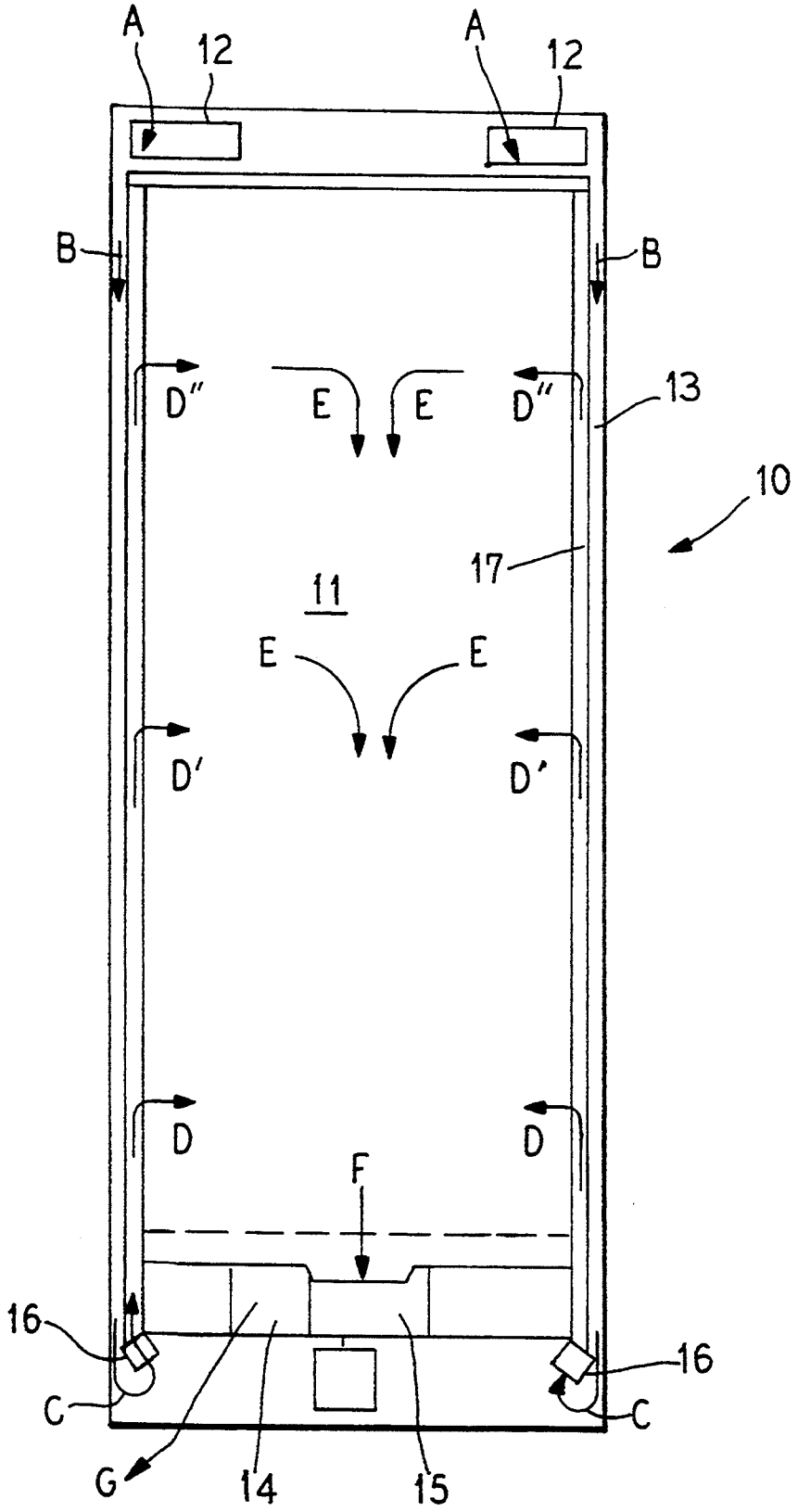
FIG. 1 is a schematic front sectional view of a drying chamber.

Referring to FIG. 1, a generally box shaped drying chamber 10 comprises an inner chamber 11 laterally defined by a first intermediate chamber 13 and a second intermediate chamber 17. In the upper area of the drying chamber 10 two air inlet openings 12 are arranged.

Below the inner chamber 11 an air outlet opening 14 is visible and a fan 15 which is to be controllably driven by a motor is arranged therebelow.

At the lower border between the first intermediate chamber 13 and the second intermediate chamber 17 a heating device 16 is arranged through which the air stream is positively conducted.

In the example of the method illustrated in FIG. 1, the air stream flows according to the arrows A to G.

At A the air stream enters through the air inlet opening 12, flows according to B through the first intermediate chamber 13, flows at C through the heating device 16, flows through the second intermediate chamber 17 according to D, D', D'', and enters into the inner chamber 11 from the right and the left side is indicated with the arrows D, D', D'', passes through the fabric parts (not shown) present there, as indicated by E, is drawn in by the fan 15 at F and is discharged or directed outside through the outlet opening 14 at G.

With the example illustrated there is an open passage, which, e.g., is suitable for detoxication and sterilization. The exhaust air, for practical reason, is led into the atmosphere through a hose connection.

The devices for spraying and the like are not indicated as they are well known.

Figure 2:
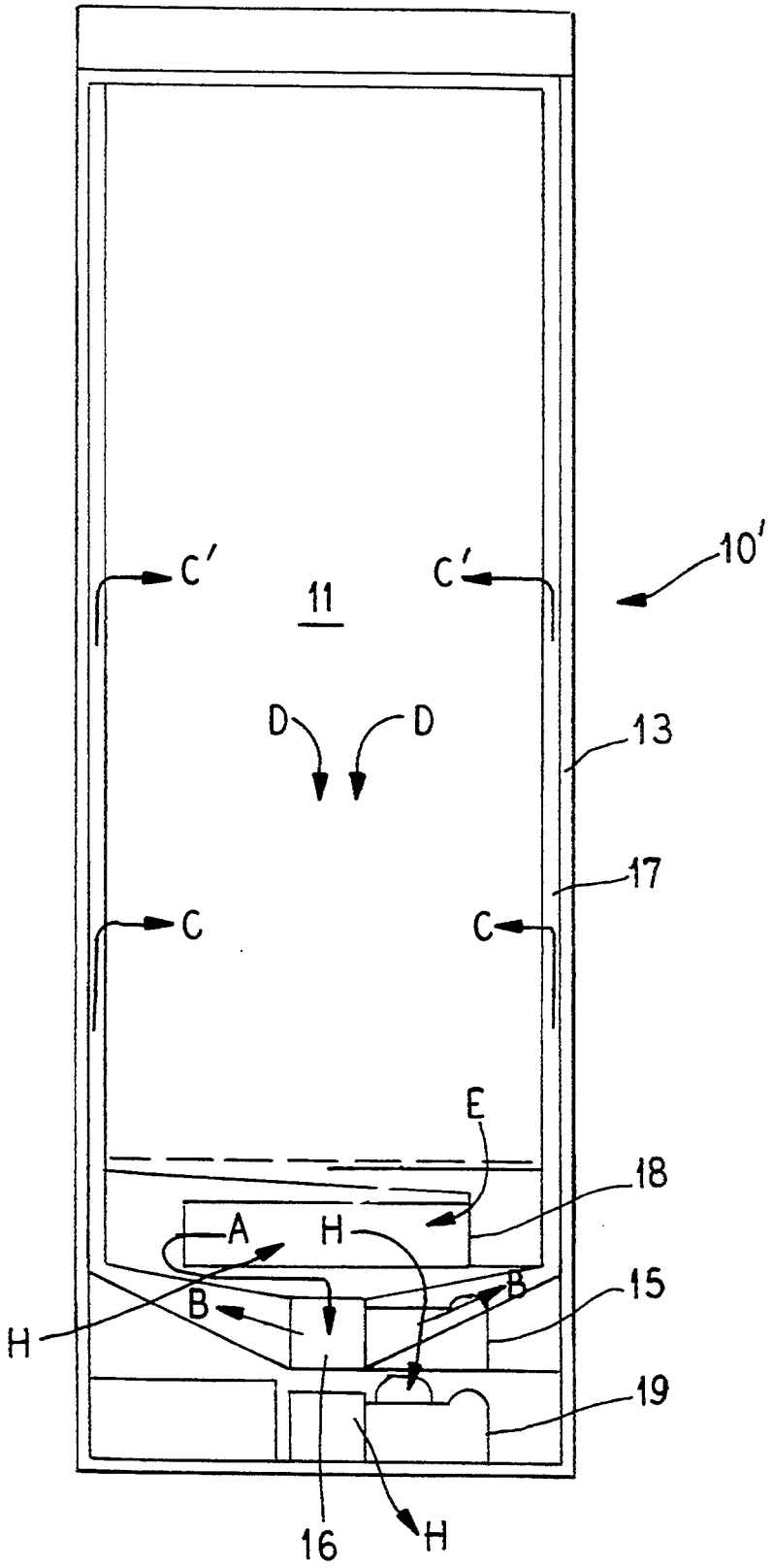
FIG. 2 is a further embodiment in a view similar to FIG. 1.

FIG. 2 illustrates a drying chamber 10' with an inner chamber 11, a first intermediate chamber 13 and a second intermediate chamber 17. The fan 15 is connected with a heating device 16 such that the air stream drawn in by the fan 15 is discharged through the heating device 16. Furthermore FIG. 2 illustrates a condenser 18 through which a second air stream H flows as a cooling agent wherein the second air stream is moved by a second fan 19. Air inlet and outlet openings for the second air stream are arranged in the lower area of the drying chamber 10' and are not particularly designated.

With the example of the method shown in FIG. 2, the air stream is moved in a closed circle according to the arrows A to E wherein the air inlet and outlet openings for this air stream are closed during the time of this operation.

The air stream leaves the condenser 18 at A, wherein the air stream was dried, then is drawn in by the fan 15 and is discharged through the heating device 16 into the second intermediate chamber 17 according to B wherefrom the air stream enters the inner chamber 11 from two opposite sides according to C and C', where the air stream dries the fabrics and, for closing the circulation loop, enters the condenser 18 according to D and E. The circulation shown is particularly suitable for drying fabric parts but also for detoxication, wherein a part of the contaminants will also condense and thus be withdrawn from the air.

Figure 3:
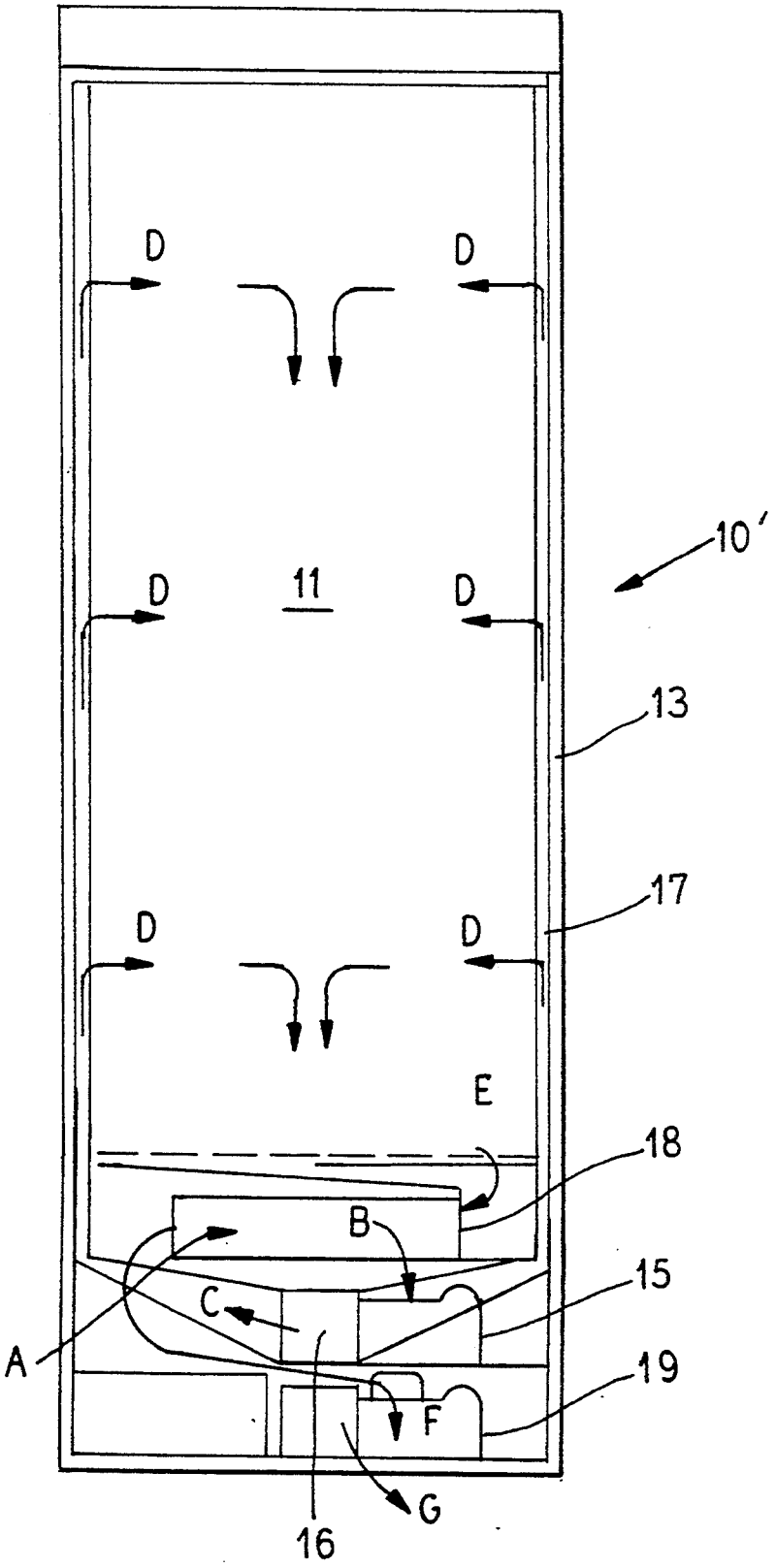
FIG. 3 is an embodiment of FIG. 2 with a modified air stream guiding.

In FIG. 3 the same drying chamber 10' is shown as in FIG. 2, the example of the method in this case is an open passage of the air without activation of the heating device wherein the example is suitable for a vicarious aeration of the fabric parts arranged in the inner chamber 11.

The air stream is moved according to the arrows A to G. At A the air stream enters into the condenser 18 wherein it passes the condenser like in the example according to FIG. 2. The air stream is then drawn in by the fan 15 according to B and is discharged through the non-activated heating device 16 according to C into the second intermediate chamber 17. The air stream flows through a plurality of apertures whereof only some are indicated at D, then it flows into the inner chamber 11 wherefrom it enters the condenser 18 according to E and leaves it according to F, is drawn in by a second fan 19 and is discharged outside according to G.

With this example the fans 15 and 19 act in a double action on the same air stream and thereby reinforce the movement.

The air stream passes the condenser 18 first at the side providing the cooling agent and thereafter at the other side.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A method for removing chemicals present in and on clothing materials comprising the steps of:

introducing the clothing materials into a drying chamber comprising an inner chamber;

heating a supply of air to a temperature elevated above room temperature, but below a temperature which would be harmful to said materials, continuously supplying said heated air through opposing apertures in walls defining said inner chamber, exhausting the air through an air exhaust in a bottom wall of said inner chamber, performing said supplying and exhausting so as to result in about equal thermodynamic state variables, comprising at least one of temperature, pressure, volume flow chemical potential and thermodynamic imbalance, arising throughout said inner chamber, and providing a maximal evaporation of the individual chemicals present by means of thermal conditions of vapor pressure of the chemicals present at a minimal partial pressure based on the continuous air supply.

2. A method according to claim 1, wherein said clothing materials introduced comprise at least one of textiles, leather garments and shoes.

3. A method according to claim 1, wherein said steps of heating, continuously supplying and exhausting said air comprise:

directing an air stream into a first intermediate chamber between an outer and an inner shell of the drying chamber;

heating said air stream after it has passed through the first intermediate chamber, directing the heated air stream through a second intermediate chamber defined by an inward facing wall of the first intermediate chamber and a wall of the inner chamber, directing the heated air stream from the second intermediate chamber through said apertures into said inner chamber, and drawing said air stream from said inner chamber through the air exhaust by a first fan, and discharging said air stream through an air outlet opening to the atmosphere.

4. A method according to claim 3, wherein said air drawn through the air exhaust is conducted through a condenser and thereafter is drawn through said first fan and discharged into said inner chamber.

5. A method according to claim 4, wherein said air drawn through the fan is subsequently directed through the second intermediate chamber such that the air stream is recirculated.

6. The method according to claim 3, wherein said air drawn through the air exhaust is conducted through a condenser and thereafter is drawn through a second fan and discharged through the air outlet opening to the atmosphere.

7. A method for removing chemicals present in and on clothing materials comprising the steps of:

introducing the clothing materials into a drying chamber comprising an inner chamber;

heating a supply of air to a temperature elevated above room temperature, but below a temperature which would be harmful to said materials, continuously supplying said heated air through opposing apertures in walls defining said inner chamber, exhausting the air through an air exhaust in a bottom wall of said inner chamber, performing said supplying and exhausting so as to result in about equal thermodynamic state variables, comprising at least one of temperature, pressure, volume flow chemical potential and thermodynamic imbalance, arising throughout said inner chamber, and providing a maximal evaporation of the individual chemicals present by means of thermal conditions of vapor pressure of the chemicals present at a minimal partial pressure based on the continuous air supply;

directing said air stream through a condenser prior to heating said air stream to provide a cooling of said condenser, drawing said air stream from said condenser by a fan and then directing it through a heater to said inner chamber, withdrawing said air from said inner chamber through said condenser to dehumidify said air, and drawing said air from said condenser by a second fan.

* * * * *